US008627879B2

(12) United States Patent
Rosenfeld et al.

(10) Patent No.: US 8,627,879 B2
(45) Date of Patent: Jan. 14, 2014

(54) CAPILLARY ASSISTED LOOP THERMOSIPHON APPARATUS

(75) Inventors: John H. Rosenfeld, Lancaster, PA (US); Kenneth G. Minnerly, Lititz, PA (US)

(73) Assignee: Thermal Corp., Wilmington, DE (US)

( * ) Notice: Subject to any disclaimer, the term of this patent is extended or adjusted under 35 U.S.C. 154(b) by 87 days.

(21) Appl. No.: 12/917,090

(22) Filed: Nov. 1, 2010

(65) Prior Publication Data

US 2011/0042045 A1 Feb. 24, 2011

Related U.S. Application Data

(63) Continuation of application No. 10/805,142, filed on Mar. 19, 2004, now Pat. No. 7,823,629.

(60) Provisional application No. 60/456,262, filed on Mar. 20, 2003.

(51) Int. Cl.
*F28D 15/00* (2006.01)
*H05K 7/20* (2006.01)

(52) U.S. Cl.
USPC ..... 165/104.26; 165/104.21

(58) Field of Classification Search
USPC ..... 165/104.21, 104.26, 104.33, 104.22, 165/104.28, 80.4, 115, 116; 361/699–700; 257/714–715
See application file for complete search history.

(56) References Cited

U.S. PATENT DOCUMENTS 3,095,255 A * 6/1963 Smith ..... 62/512
3,609,206 A * 9/1971 McConnell ..... 174/15.6
4,046,190 A * 9/1977 Marcus et al. ..... 165/104.26
4,274,479 A * 6/1981 Eastman ..... 165/104.26
4,352,392 A * 10/1982 Eastman ..... 165/104.25
4,503,483 A * 3/1985 Basiulis ..... 361/700
6,223,810 B1 * 5/2001 Chu et al. ..... 165/104.33
6,330,907 B1 * 12/2001 Ogushi et al. ..... 165/104.26
6,382,309 B1 5/2002 Kroliczek et al.
6,536,510 B2 * 3/2003 Khrustalev et al. ..... 165/104.33
6,657,121 B2 12/2003 Garner
6,675,872 B2 1/2004 Lewis et al.
6,675,874 B2 1/2004 Mast et al.
6,675,887 B2 1/2004 Garner et al.
6,679,081 B2 * 1/2004 Marsala ..... 62/259.2
6,840,304 B1 * 1/2005 Kobayashi et al. ..... 165/11.1
2004/0069459 A1 * 4/2004 Tonosaki et al. ..... 165/104.25

OTHER PUBLICATIONS

Conroy, C., Mahorter, R., Savchik, J., Hoang, T., O'Connell, T., and Rosenfeld, J., Multiple Flat Plate Evaporator Loop Heat Pipe Demonstration, American Institute of Aeronautics and Astronautics, date unknown.

Rosenfeld, J., Development of a Gravity-Assist Water Loop Heat Pipe With Flat Evaporator for Waste Heat Removal, date unknown.

(Continued)

*Primary Examiner* — Tho V Duong

(74) *Attorney, Agent, or Firm* — Michael Best & Friedrich LLP

(57) ABSTRACT

A capillary assisted loop thermosiphon apparatus (100) has at least one evaporator (102) connected by a vapor line (104) to a condenser (106); a liquid line (108) connects the condenser (106) and the evaporator (102), the evaporator (102) is in the direction of gravity from the condenser (106) for the condenser (106) to supply liquid under gravity induced pressure to the evaporator (102), and the evaporator (102) has a vertical capillary wick (102*a*) in which liquid wicks in the direction of gravity.

32 Claims, 4 Drawing Sheets

(56) References Cited

OTHER PUBLICATIONS

Cullimore, B., Capillary Pumped Loop Application Guide, 23rd International Conference on Environmental Systems, Colorado Springs, CO, 1993.
Ku, J., Overview of Capillary Pumped Loop Technology, 1993 ASME National Heat Transfer Conference, Atlanta, GA, 1993.
Hoang, T. and Ku, J., Hydrodynamic Aspects of Capillary Pumped Loop, 26th International Conference on Environmental Systems, Monterey, CA, 1996.
Toth, J., DeHoff, R., Grubb, K., Heat Pipes: The Silent Way to Manage Desktop Thermal Problems, 1998 I-THERM Conference, Seattle, WA, 1998.
Kaya, T. and Hoang, T., Mathematical Modeling of Loop Heat Pipes and Experimental Validation, Journal of Thermophysics and Heat Transfer, vol. 13, No. 3, Jul.-Sep. 1999.
Ku, J., Operational Characteristics of Loop Heat Pipes, 29th International Conference on Environmental Systems, Denver, CO, 1999, May 18, 2012.
Hoang, T., O'Connell, T., Conroy, C., Mahorter, R., Savchik, J., and Rosenfeld, J., Development of a Gravity-Assist Water Loop Heat Pipe With Flat Evaporator for Waste Heat Removal, 2003 ASME National Conference, Las Vegas, NV, 2003.
Maydanik, Y., Pastukhov, V., Chernyshova, M. Delil, A., Development and Test Results of a Multi-Evaporator-Condenser Loop Heat Pipe, Space Technology and Applications International Forum, 2003 STAIF.
Ottenstein, Butler, D., Ku, J., Cheung, K., Baldauff, R., and Hoang, T., Flight Testing of the Capillary Pumped Loop 3 Experiment, Space Technology and Applications International Forum, 2003 STAIF, May 18, 2012.

* cited by examiner

CAPILLARY ASSISTED LOOP THERMOSIPHON APPARATUS

CROSS REFERENCE TO RELATED APPLICATION

This application claims the benefit of U.S. Provisional Application No. 60/456,262, Filed Mar. 20, 2003.

FIELD OF THE INVENTION

The present application relates to a capillary assisted loop thermosiphon apparatus having an evaporator that is heated to evaporate liquid phase working fluid, and the evaporator has a capillary wick for wicking the liquid phase working fluid and expelling the vapor, to provide capillary pumping.

BACKGROUND

Electronic equipment produce waste heat that must be removed to avoid equipment malfunction. Removing the heat by circulating pumped water or fan driven air would consume power and further would create rapid temperature changes to produce detrimental thermal gradients in the equipment. Removing the heat by a closed loop thermal siphon would eliminate power consumption, but the siphoned medium would produce the detrimental thermal gradients in the equipment.

A capillary assisted loop thermosiphon apparatus is a closed loop fluid transport system that circulates working fluid by thermal siphoning assisted by capillary pumping. The working fluid is wicked into a capillary wick in evaporator that is heated, for example, by waste heat generated by electronic equipment. In the evaporator, the working fluid absorbs the heat to undergo a phase change from liquid to vapor. The term "liquid" herein refers to liquid phase working fluid. The term "vapor" herein refers to vapor phase working fluid. The wicking action and the increase in vapor pressure provide capillary pumping head pressure for displacing the working fluid forwardly in the heat pipe loop. The vapor circulates by capillary pumping to the condenser that condenses the vapor and dissipates the heat, and the liquid circulates to the evaporator by way of a liquid line. While heating the evaporator, it would be desirable to maintain the evaporator heating surface isothermal to eliminate potentially detrimental thermal gradients. A liquid saturated wick structure in the evaporator is desired, which would maintain the desired evaporator heating surface isothermal at the saturation temperature, while the evaporator is heated.

Further, the heat transport capacity of the capillary loop heat pipe is limited because the capillary pumping capacity is limited, as when low density vapor flow approaches the sonic limit. It would be desirable to increase the heat transport capacity of the capillary loop heat pipe by augmenting the capillary pumping capacity.

SUMMARY OF THE INVENTION

According to the invention, a capillary pumped heat pipe has an evaporator in which working fluid is wicked by capillary action, absorbs heat and undergoes a phase change to a vapor that circulates by the capillary action to a condenser. The condenser dissipates heat to convert the vapor to a liquid. To increase the capillary pumping capacity, the evaporator is in the direction of gravity from the condenser for the condenser to supply gravity assisted circulation or flow of the liquid in a liquid line from the condenser to the evaporator.

According to an advantage of the invention, the capillary pumping capacity of the capillary assisted loop thermosiphon apparatus is augmented by gravity assisted liquid flow in the liquid line. According to a further advantage of the invention, the heat transport capacity of the heat pipe is increased by gravity assistance. According to a further advantage of the invention, a gravity assisted liquid saturates the wick structure in the evaporator to maintain the evaporator heating surface isothermal at the saturation temperature.

According to a further embodiment of the invention, a liquid feed line is along the top of the evaporator, and spaced apart sections of the wick extend along interior facing major heating surfaces of the evaporator, and a vapor channel is defined between the spaced apart wick sections. A series of irrigation distribution openings along the length of the liquid feed line and communicating with the spaced apart sections of the wick to saturate the wick with gravity assisted liquid flow.

According to a further embodiment of the invention, one or more evaporators are connected by a manifold in the capillary assisted loop thermosiphon apparatus.

DETAILED DESCRIPTION

Figure 1:
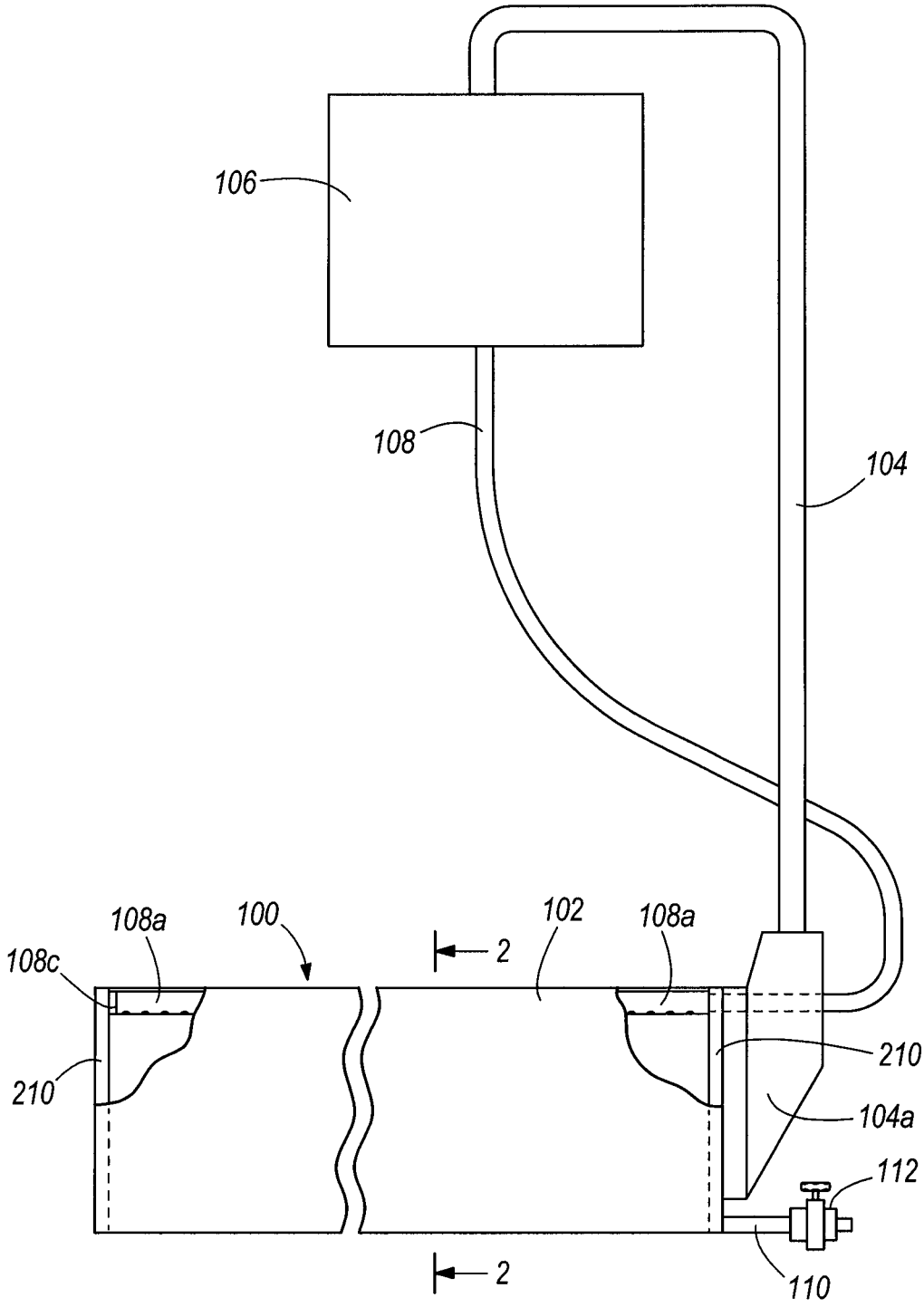
FIG. 1 is a schematic view of a capillary assisted loop thermosiphon apparatus.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 discloses a capillary assisted loop thermosiphon apparatus (100) for transporting waste heat and dissipating the same via a closed loop circulating system that is evacuated to less than one atmosphere internal pressure. The heat pipe (100) internally circulates a working fluid, including and not limited to, water, acetone, methanol, and any other fluid with a vapor pressure that would not exceed the rupture strength of the heat pipe (100). Selection of water as the working fluid is desired as being nontoxic and substantially non-corrosive to copper construction of the heat pipe (100). The heat pipe (100) is evacuated to have an internal pressure below one atmosphere.

The heat pipe (100) has at least one evaporator (102) that conducts heat to the working fluid to convert liquid to vapor at the vaporization temperature. The evaporator (102) is heated, for example, by waste heat that is required to be transported and dissipated. The evaporator (102) is connected by a vapor line (104) to a condenser (106). Vapor is transported via the vapor line (104) to the condenser (106) where the vapor is condensed to a liquid by having the condenser (106) dissipate the heat. However, below 80 degrees C., vapor flow is susceptible to being impeded by the sonic limit of the low vapor density. The condenser (106) is connected by a liquid line (108) also known as a liquid return line, that returns liquid phase working fluid to the evaporator (102).

Figure 2:
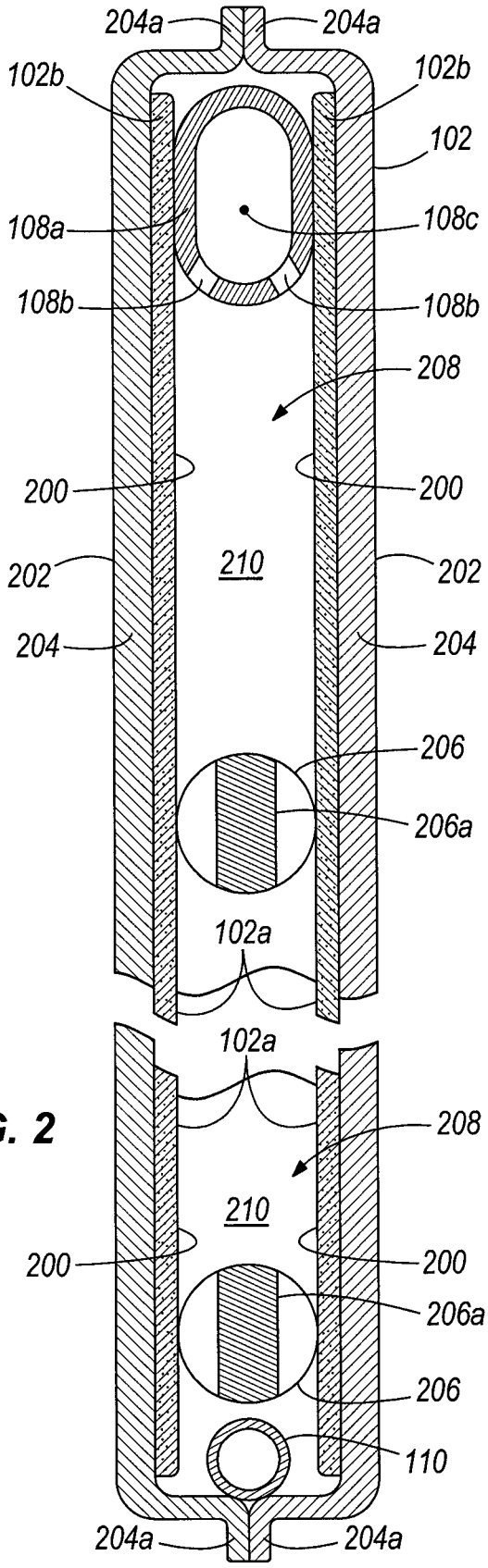
FIG. 2 is an enlarged fragmentary section view of a portion of FIG. 1 taken along the line 2-2.

With reference to FIG. 2, the evaporator (102) has a capillary wick (102*a*), also known as a capillary pump into which the liquid is wicked by capillary action. The liquid that has wicked into the capillary wick (102*a*) absorbs the heat that is conducted by the evaporator (102) and the capillary wick (102*a*). Further the liquid changes to vapor phase, which increases the vapor pressure. A combination of wicking and increased vapor pressure produces capillary pumping to circulate or transport the vapor to the condenser (106).

A drawback associated with a capillary pump is that the heat conducted by the capillary pump to the incoming liquid would raise the loop operating temperature, and the incoming liquid would need to be sub-cooled in the condenser (106) to balance the loop operating temperature. Thus, by requiring the condenser (106) to have a portion of its heat rejection capacity directed to sub-cooling the liquid, the heat rejection efficiency of the condenser (106) would be reduced. According to another drawback associated with a capillary pump is the tendency for vapor bubbles to form in the capillary pump and impede the capillary flow of liquid in the capillary pump. Potential causes of vapor bubbles include, the presence of vapor bubbles prior to start up of heat pipe operation, heat conduction by the evaporator (102) to the capillary pump causing formation of vapor bubbles, and boiling of the working fluid prematurely before the liquid reaches the capillary pump.

FIG. 2 discloses the capillary wick (102*a*) as having a corresponding capillary wick portion (200) in conducting engagement with a heat absorbing surface (202) on a sheet (204) of heat conducting material, for example, a sheet (204) of copper. The sheet (204) is disclosed by FIG. 2A as being flat, although the sheet (204) can be shaped to conform the heat absorbing surface (202) to different corresponding heat sources. The wick portion (200) is a porous layer that wicks liquid phase working fluid in the pores thereof. The liquid absorbs heat that is conducted by the wick portion (200), and converts to vapor. The wick portion (200) is fabricated of particles of a sintering material that are, first, compacted, followed by heating the surface molecules of the compacted particles to a fluent state. The particles are cooled to solidify and fuse to one another to form the sintered, porous capillary wick (102*a*). The capillary wick portion (200) has pores that wick the liquid working fluid to induce capillary pumping. According to an embodiment of the invention, copper powder for the wick portion (200) is sintered in situ on the interior surface of the sheet (204), which secures the wick portion (200) to each sheet (204). Alternatively, the wick portion (200) is fabricated separately, and is attached with conducting adhesive or filler adhesive or conducting solder to the sheet (204). A pore size between 20 and 25 microns was necessary to provide a capillary pumped pressure head. Porosity in excess of, or greater than, 40 percent is desired to minimize internal flow resistance. At full power operation, the pumping pressure head is augmented by gravity in a manner to be described. Further details of a porous wick are disclosed by U.S. Pat. No. 6,382,309. For example, each wick portion (200) is a layer of 0.08 cm thickness. The thickness of each sheet (204) is 0.24 cm. A wick portion (200) in a thin layer configuration ensures even distribution of liquid saturating the heat transfer surface to maintain isothermal conditions.

With continued reference to FIG. 2, the evaporator (102) has a second sheet (204) similar to the first sheet (204). According to an embodiment of the invention, the second sheet (204) has a corresponding wick portion (200). According to another embodiment of the invention the second sheet (204) can be by itself without a corresponding wick portion (200). Accordingly, the evaporator (102) has at least a pair of sheets (204) with at least one of the sheets (204) having a corresponding wick portion (200) attached thereto. The sheets (204) are arranged opposite each other, with a series of spaced apart reinforcing rods (206) between the wick (200) on the first sheet (204) and the second sheet (204). Further, when the second sheet (204) has corresponding wick portion (200), the reinforcing rods (206) are between the wicks (200). The reinforcing rods (206) define a vertical vapor collection cavity (208) adjacent to each corresponding vertical wick portion (200). The reinforcing rods (206) extend lengthwise across the surface of each corresponding wick portion (200) and define the cavity (208) over the surface. Further, the reinforcing rods (206) prevent collapse of each corresponding vertical wick portion (200) into the vertical vapor collection cavity (208).

For example, the reinforcing rods (206) are 0.6 cm diameter to define a 0.6 cm wide, vertical vapor collection cavity (208), which maintains the local Mach number to less than 0.2. The reinforcing rods (206) extend to a perimeter end cap (210). The ends of the reinforcing rods (206) are joined to the end cap (210). The reinforcing rods (206) prevent collapse of the vapor collection cavity (208) that is under partial vacuum when the loop heat pipe (100) is evacuated. Further, the exteriors of the reinforcing rods (206) have indents (206*a*), for example, machined grooves or swaged narrow necks, to allow passage of vapor in the vertical vapor collection cavity (208), particularly due to displacement of the vapor by thermal siphoning. The sheets (204) are bent along their edges to form perimeter flanges (204*a*) that are joined and hermetically sealed, for example, by brazing or welding. Further the sheets (204) are joined and hermetically sealed to the end cap (210), to enclose each corresponding capillary wick (200).

With reference to FIG. 1, a hollow vapor line portion (104*a*) forms a hood or boot at one of the perimeter end caps (208) for coupling to a remainder of the vapor line (104). The hollow vapor line portion (104*a*) communicates along a vertical end that extends to a top portion of the evaporator (102) to transport vapor that can thermally siphon in the evaporator (102).

With continued reference to FIG. 2, a liquid line irrigator (108*a*) couples to a remainder of the liquid line (108). For example, the liquid line irrigator (108*a*) is a copper tube flattened to 0.6 cm wide. The liquid line irrigator (108*a*) extends along a top section (102*b*) of the capillary wick (102*a*). More specifically, the top section (102*b*) of the capillary wick (102*a*) is a corresponding top section (102*b*) of each capillary wick portion (200). A series of liquid dispensing openings (108*b*) are distributed along a length of the liquid line irrigator (108*a*) to drip and distribute liquid phase working fluid under gravity assistance along the length of a top section (102*b*) of the capillary wick (102*a*). A first series of the openings (108*b*) face toward a corresponding top section (102*b*) of a first capillary wick portion (200). A second series of the openings (108*b*) face toward a corresponding top section (102*b*) of a second capillary wick portion (200). A terminal end (108*c*) of the liquid line irrigator (108*a*) is welded shut. When the length of the irrigator (108*a*) is substantially horizontal, the gravity induced fluid pressure will be substantially the same along the length of the irrigator (108*a*), assuming friction losses to be negligible. Further, when the length of the irrigator (108*a*) is tilted relative to horizontal, the gravity induced fluid pressure would vary with the length of the irrigator (108*a*). Accordingly, the sizes of the openings and distribution pattern of the openings are adjusted to compensate for an irrigator (108*a*) that is tilted relative to horizontal.

By locating the liquid line irrigator (108*a*) along the top section (102*b*) the liquid line irrigator (108*a*) is spaced from the heat absorbing surface (202) to avoid premature boiling of the liquid due to heat conducted by the heat absorbing surface (202). Further, the liquid wicks in a descending direction in the capillary wick (102*a*), which saturates the capillary wick (102*a*) with liquid even if vapor bubbles are present prior to start up of the heat pump (100). At start up, vapor begins thermally siphoning in the vertical vapor collection cavity (208), which increases the vapor pressure to the condenser (106) and a correspondingly increases liquid pressure from the condenser (106) to overcome any impediment to capillary pumping by vapor bubbles in the capillary wick (102*a*). Further, the liquid under gravity induced pressure by the elevated condenser (106), and the descending direction of capillary pumping moves the mass of condensed liquid forwardly in the loop direction to balance any tendency for a rise in loop operating temperature due to heat conducted by the capillary pump.

Further, because the liquid wicks in the capillary wick (102*a*) in a descending direction, the capillary wick (102*a*) is saturated with the liquid. As heat is conducted by the heat absorbing surface (202) on each sheet (204), the capillary wick (102*a*) conducts the heat to the liquid, and the liquid saturation maintains the capillary wick (102*a*) isothermal at the saturation temperature. The upper limit of the saturation temperature is equal to the vaporization temperature of the liquid. Thereby, the heat absorbing surface (202) is maintained similarly isothermal.

Under low power operation, excess liquid accumulates in the bottom of the evaporator (102), which provides a liquid reservoir or sump. A substantially small portion of the capillary wick (102*a*) is wetted by the accumulated liquid, while a substantial portion of the capillary wick (102*a*) projects outwardly from the accumulated liquid. The loop heat pipe (100) of the invention eliminates the need for a separate liquid reservoir. According to another embodiment of the invention when multiple evaporators (102) are combined with a single condenser (106), the bottoms of the evaporators (102) are interconnected to provide a common shared liquid reservoir or sump shared among the evaporators (102). For example, the bottom of each evaporator (102) is interconnected to others by a pipe (110) with a shut off valve (112). The shared liquid reservoir or sump assures that none of the evaporators (102) would divert liquid away from the others.

Figure 2A:
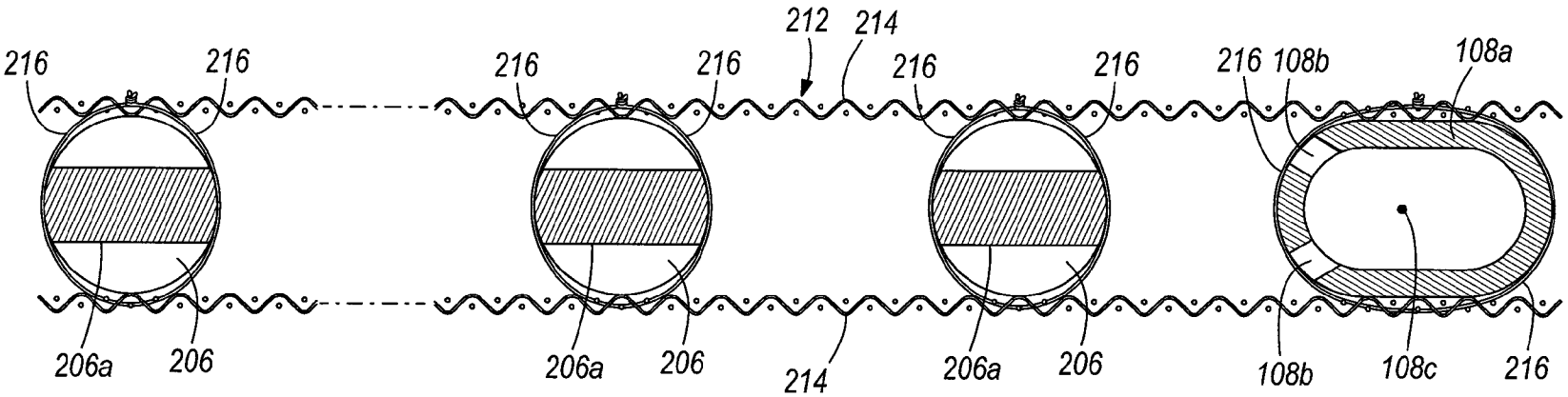
FIG. 2A is an enlarged fragmentary section view of a portion of an embodiment of a subassembly.

With reference to FIG. 2A, according to an alternative embodiment of the invention, a subassembly (212) includes the irrigator (108*a*) and each of the reinforcing rods (206) in between a first porous backing layer (214) and a second porous backing layer (214). For example, each backing layer (214) is a porous wire mesh or screen of woven fine wires. A copper screen is preferred, although a screen of any material that is chemically compatible with the apparatus (100) would be suitable. The irrigator (108*a*) is attached to the first wire mesh (214) and to the second wire mesh (214), if present, by tying one or more wire laces (216) around the diameter of the irrigator (108*a*). Further, the wire laces (216) are threaded through openings in each wire mesh (214). Then opposite ends of each wire lace (216) is twisted together or tied together, which secures the irrigator (108*a*) in a desired position that corresponds to its position in the evaporator (102) as disclosed by FIG. 2. Advantageously, each of the wire laces (216) is a wire strand that has been unraveled from a wire mesh that has supplied each porous backing layer (214).

Similarly, each of the reinforcing rods (206) is attached to the first wire mesh (214) and to the second wire mesh (214), if present, by tying one or more additional wire laces (216) around the diameter of a respective reinforcing rod (206). Further, the wire laces (216) are threaded through openings in each wire mesh (214). Then opposite ends of each wire lace (216) is twisted together or tied together, which secures the respective reinforcing rod (206) in a desired position that corresponds to its position in the evaporator (102) as disclosed by FIG. 2.

The evaporator (102) is disclosed by FIG. 2 as being assembled with the irrigator (108*a*) and the reinforcing rods (206), without requiring the first wire mesh (214) or the second wire mesh (214). Alternatively, the irrigator (108*a*) and the reinforcing rods (206) are first assembled in the subassembly (212) with the first wire mesh (214) and the second wire mesh (214), as disclosed by FIG. 2A. Then, when the subassembly (212) is assembled in the evaporator (102), the first wire mesh (214) and the second wire mesh (214) assist in holding the irrigator (108*a*) in place, and assist in holding each reinforcing rod (216) in place. Further, the first wire mesh (214) and the second wire mesh (214) provide standoffs for supporting the wicks (200) from collapsing over the reinforcing rods (206).

Further, because the first wire mesh (214) and the second wire mesh (214) are porous, they extend the vapor collection cavity (208) alongside the surfaces of the wicks (200) and between each wick (200) and each of the reinforcing rods (206). When only one of the sheets (202) has a corresponding wick (200), then only one porous reinforcing sheet (214) is present to extend the vapor collection cavity (208) alongside the surface of the wick (200) and between the wick (200) and each of the reinforcing rods (206).

Figure 3:
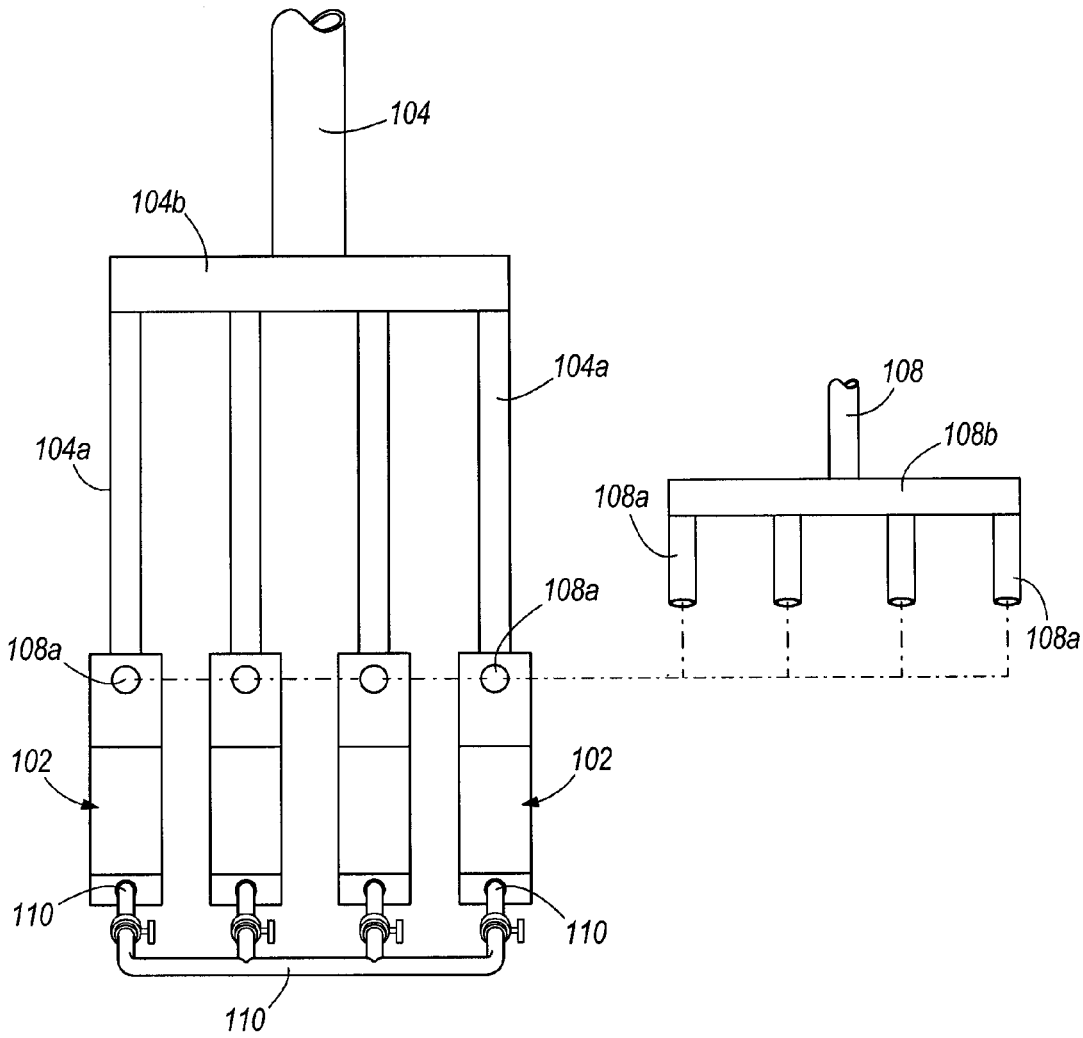
FIG. 3 is a diagrammatic view of multiple evaporators for a capillary assisted loop thermosiphon apparatus.

With reference to FIG. 3, according to another embodiment of the invention the multiple evaporators (102) are combined by coupling each vapor line portion (104*a*) to the vapor line (104). For example, a vapor manifold (104*b*) is a known pipe coupling device that has one inlet for coupling the vapor line (104) and multiple outlets for coupling respective vapor line portions (104*a*). Further, the multiple evaporators (102) are combined by coupling each liquid line irrigator (108*a*) to the remainder of the liquid line (108). For example, a manifold (108*b*) is a known pipe coupling device that has one inlet for coupling the liquid line (108) and multiple outlets for coupling respective liquid line irrigators (108*a*). For each evaporator (102), the corresponding liquid line (108) descends from the condenser (106) located above the evaporator (102) for circulating liquid under gravity induced pressure to the evaporator (102).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A capillary assisted loop thermosiphon apparatus, comprising:

an evaporator;

a capillary wick disposed in the evaporator;

a condenser in fluid communication with the evaporator, wherein the evaporator is positioned in the direction of gravity below the condenser;

a vapor line having a first end connected to the condenser and a second end connected to the evaporator;

a liquid line having a first end connected to the condenser and a second end connected to the evaporator; and a liquid irrigator connected to the second end of the liquid line, wherein the liquid irrigator extends along the capillary wick to dispense liquid to the capillary wick, wherein the evaporator has a first longitudinal surface and a second longitudinal surface, the second longitudinal surface being spaced below the first longitudinal surface in the direction of gravity, wherein the second end of the liquid line is connected to the evaporator adjacent the first longitudinal surface of the evaporator, and wherein the vapor line connects to a first manifold having multiple outlets for connecting respective vapor lines of multiple evaporators, the liquid line connects to a second manifold having multiple outlets for connecting to respective liquid line irrigators for the multiple evaporators, and the multiple evaporators are interconnected along their bottoms to share a common liquid reservoir.

2. The capillary assisted loop thermosiphon apparatus as in claim 1, wherein the evaporator has a height in a direction of gravity greater than a width perpendicular to the height.

3. The capillary assisted loop thermosiphon apparatus as in claim 2, wherein the first end of the liquid line is positioned in the direction of gravity below the first end of the vapor line.

4. The capillary assisted loop thermosiphon apparatus as in claim 1, wherein a reinforcing member is disposed within the evaporator, the reinforcing member extending in a direction along the length of the evaporator and separating an interior of the evaporator into a first vapor collection cavity and a second vapor collection cavity, the second vapor collection cavity being positioned in the direction of gravity below the first vapor collection cavity.

5. The capillary assisted loop thermosiphon apparatus as in claim 1, wherein a vapor collection cavity extends vertically along the capillary wick, and the vapor collection cavity is connected to the vapor line.

6. The capillary assisted loop thermosiphon apparatus as in claim 1, wherein the capillary wick extends vertically against a heat absorbing surface on the evaporator; and a vapor collection cavity extends vertically along the capillary wick, the vapor collection cavity being connected to the vapor line.

7. The capillary assisted loop thermosiphon apparatus as in claim 1, wherein the liquid line irrigator supplies liquid under gravity-induced pressure to a vertical heat conducting section of the capillary wick;

the capillary wick extends in conducting engagement along at least one heat absorbing surface on the evaporator; and a vertical vapor collection cavity in the heat conducting section of the capillary wick extends vertically along the capillary wick, and the vapor collection cavity is connected to the vapor line.

8. The capillary assisted loop thermosiphon apparatus as in claim 1, wherein the capillary wick is a layer of porous sintered material on a sheet of conducting material.

9. A capillary assisted loop thermosiphon apparatus, comprising:

an evaporator;

a capillary wick disposed in the evaporator;

a condenser in fluid communication with the evaporator, wherein the evaporator is positioned in the direction of gravity below the condenser;

a vapor line having a first end connected to the condenser and a second end connected to the evaporator;

a liquid line having a first end connected to the condenser and a second end connected to the evaporator; and a liquid irrigator connected to the second end of the liquid line, wherein the liquid irrigator extends along the capillary wick to dispense liquid to the capillary wick, wherein the evaporator has a first longitudinal surface and a second longitudinal surface, the second longitudinal surface being spaced below the first longitudinal surface in the direction of gravity, wherein the second end of the liquid line is connected to the evaporator adjacent the first longitudinal surface of the evaporator, and wherein the capillary wick comprises a first layer of porous sintered material on a first sheet of conducting material, and a second layer of porous sintered material on a second sheet of conducting material;

reinforcing rods between the first layer and the second layer define a vapor collection cavity therebetween, and the vapor collection cavity connects to the vapor line; and the reinforcing rods are secured to at least one porous backing layer.

10. The capillary assisted loop thermosiphon apparatus as in claim 1, wherein the capillary wick comprises a layer of sintered conducting material on a sheet of conducting material;

the liquid irrigator extends along a top portion of the capillary wick; and a series of fluid distribution openings in the liquid irrigator supplies liquid to the capillary wick.

11. A capillary assisted loop thermosiphon apparatus, comprising:

an evaporator having a height in a direction of gravity greater than a width perpendicular to the height, a first surface extending in a direction along the height of the evaporator and a second surface extending in a direction along the height of the evaporator and spaced away from the first surface, a first longitudinal surface, and a second longitudinal surface spaced away from the first longitudinal surface in the direction of gravity;

a capillary wick disposed in the evaporator on one of the first and second surfaces that extend along a height of the evaporator, wherein capillary action occurs in the direction of gravity;

a condenser in fluid communication with the evaporator;

a vapor line having a first end connected to the condenser and a second end connected to the evaporator; and a liquid line having a first end connected to the condenser and a second end connected to the evaporator;

wherein the first end of the liquid line is positioned in the direction of gravity below the first end of the vapor line and the second end of the liquid line is positioned adjacent the first longitudinal surface of the evaporator, and wherein the capillary wick comprises a first layer of porous sintered material on a first sheet of conducting material and a second layer of porous sintered material on a second sheet of conducting material, reinforcing rods between the first layer and the second layer define a vapor collection cavity therebetween such that the vapor collection cavity connects to the vapor line, and the reinforcing rods are secured to at least one porous backing layer.

12. The capillary assisted loop thermosiphon apparatus as in claim 11, wherein the evaporator is positioned in the direction of gravity below the condenser.

13. The capillary assisted loop thermosiphon apparatus as in claim 11, wherein a liquid irrigator, connected to the second end of the liquid line, extends along the capillary wick to dispense liquid to the capillary wick.

14. The capillary assisted loop thermosiphon apparatus as in claim 11, wherein a reinforcing member is disposed within the evaporator, the reinforcing member extends in a direction along the length of the evaporator and separates an interior of the evaporator into a first vapor collection cavity and a second vapor collection cavity positioned in the direction of gravity below the first vapor collection cavity.

15. The capillary assisted loop thermosiphon apparatus as in claim 11, wherein a vapor collection cavity extends vertically along the capillary wick, and the vapor collection cavity being connected to the vapor line.

16. The capillary assisted loop thermosiphon apparatus as in claim 11, wherein the capillary wick extends vertically against a heat absorbing surface on the evaporator; and a vapor collection cavity extends vertically along the capillary wick, the vapor collection cavity being connected to the vapor line.

17. The capillary assisted loop thermosiphon apparatus as in claim 11, wherein a liquid line irrigator connected to the liquid line supplies liquid under gravity-induced pressure to a vertical heat conducting section of the capillary wick;

the capillary wick extends in conducting engagement along at least one heat absorbing surface on the evaporator; and a vertical vapor collection cavity in the heat conducting section of the capillary wick extends vertically along the capillary wick, and the vapor collection cavity is connected to the vapor line.

18. The capillary assisted loop thermosiphon apparatus as in claim 11, wherein the capillary wick comprises a layer of porous sintered material on a sheet of conducting material.

19. The capillary assisted loop thermosiphon apparatus as in claim 11, wherein the capillary wick comprises a layer of sintered conducting material on a sheet of conducting material;

a liquid line irrigator is connected to the liquid line;

the liquid line irrigator extends along a top portion of the capillary wick; and a series of fluid distribution openings in the liquid line irrigator supplies liquid to the capillary wick.

20. The capillary assisted loop thermosiphon apparatus as in claim 11, wherein the vapor line connects to a first manifold having multiple outlets for connecting respective vapor lines of multiple evaporators;

the liquid line connects to a second manifold having multiple outlets for connecting to respective liquid line irrigators for the multiple evaporators; and the multiple evaporators are interconnected along their bottoms to share a common liquid reservoir.

21. A capillary assisted loop thermosiphon apparatus, comprising:

an evaporator having a height in a direction of gravity and a length transverse to the height, a first surface extending in a direction along the height of the evaporator and a second surface extending in a direction along the height of the evaporator and spaced away from the first surface;

a capillary wick disposed in the evaporator on one of the first and second surfaces that extend along a height of the evaporator;

a condenser in fluid communication with the evaporator;

a vapor line having a first end connected to the condenser and a second end connected to the evaporator; and a liquid line having a first end connected to the condenser and a second end connected to the evaporator; and a reinforcing member disposed within the evaporator and in contact with the capillary wick, wherein the reinforcing member extends in a direction along the length of the evaporator and separates an interior of the evaporator into a first vapor collection cavity and a second vapor collection cavity positioned in the direction of gravity from the first vapor collection cavity.

22. The capillary assisted loop thermosiphon apparatus as in claim 21, wherein the evaporator is positioned in the direction of gravity below the condenser.

23. The capillary assisted loop thermosiphon apparatus as in claim 21, wherein the evaporator has a height in a direction of gravity greater than a width perpendicular to the height, a first longitudinal surface, and a second longitudinal surface spaced away from the first longitudinal surface in the direction of gravity.

24. The capillary assisted loop thermosiphon apparatus as in claim 21, wherein the first end of the liquid line is positioned in the direction of gravity below the first end of the vapor line and the second end of the liquid line is positioned adjacent the first surface of the evaporator.

25. The capillary assisted loop thermosiphon apparatus as in claim 21, wherein a liquid irrigator, connected to the second end of the liquid line, extends along the capillary wick to dispense liquid to the capillary wick.

26. The capillary assisted loop thermosiphon apparatus as in claim 21, wherein a vapor collection cavity extends vertically along the capillary wick, and the vapor collection cavity is connected to the vapor line.

27. The capillary assisted loop thermosiphon apparatus as in claim 21, wherein a heat conducting capillary wick extends vertically against a heat absorbing surface on the evaporator; and a vapor collection cavity extends vertically along the capillary wick, the vapor collection cavity being connected to the vapor line.

28. The capillary assisted loop thermosiphon apparatus as in claim 21, wherein a liquid line irrigator connected to the liquid line supplies liquid under gravity induced pressure to a vertical heat conducting section of the capillary wick;

the capillary wick extends in conducting engagement along at least one heat absorbing surface on the evaporator; and a vertical vapor collection cavity in the heat conducting section of the capillary wick extends vertically along the capillary wick, and the vapor collection cavity is connected to the vapor line.

29. The capillary assisted loop thermosiphon apparatus as in claim 21, wherein the capillary wick is a layer of porous sintered material on a sheet of conducting material.

30. The capillary assisted loop thermosiphon apparatus as in claim 21, wherein the capillary wick comprises a first layer of porous sintered material on a first sheet of conducting material, and a second layer of porous sintered material on a second sheet of conducting material;

reinforcing rods between the first layer and the second layer define a vapor collection cavity therebetween, and the vapor collection cavity connects to the vapor line; and the reinforcing rods are secured to at least one porous backing layer.

31. The capillary assisted loop thermosiphon apparatus as in claim 21, wherein the capillary wick comprises a layer of sintered conducting material on a sheet of conducting material;

a liquid line irrigator is connected to the liquid line;

the liquid line irrigator extends along a top portion of the capillary wick; and a series of fluid distribution openings in the liquid line irrigator supplies liquid to the capillary wick.

32. The capillary assisted loop thermosiphon apparatus as in claim 21 wherein, the vapor line connects to a first manifold having multiple outlets for connecting respective vapor lines of multiple evaporators;

the liquid line connects to a second manifold having multiple outlets for connecting to respective liquid line irrigators for the multiple evaporators; and the multiple evaporators are interconnected along their bottoms to share a common liquid reservoir.

* * * * *